United States Patent [19]

Yasuda

[11] Patent Number: 5,068,518

[45] Date of Patent: Nov. 26, 1991

[54] SELF-TEMPERATURE CONTROL FLEXIBLE PLANE HEATER

[76] Inventor: Shigeyuki Yasuda, 2-27, Imaike-minami, Chigusaku, Nagoya City, Japan

[21] Appl. No.: 455,613

[22] Filed: Dec. 22, 1989

[30] Foreign Application Priority Data

Dec. 24, 1988 [JP] Japan ..... 63-326485

[51] Int. Cl.[5] ..... H05B 3/34

[52] U.S. Cl. ..... 219/549; 219/548; 252/510; 252/511; 428/209

[58] Field of Search ..... 219/548, 549; 252/510, 252/511, 502; 428/209

[56] References Cited

U.S. PATENT DOCUMENTS 4,629,584 12/1986 Yasuda ..... 252/511
4,780,247 10/1988 Yasuda ..... 252/510

FOREIGN PATENT DOCUMENTS 0219678 4/1987 European Pat. Off. .

OTHER PUBLICATIONS

"Self-Temperature-Control Heaters by Graphite-Poly(Ethylene Glycol) Mixed Systems: Mechanism of Electrical Conduction" by Tokyaki Kimura and Shigeyuki Yasuda, 526 *Polymer*, 1988, vol. 29, March.

*Primary Examiner*—Bruce A. Reynolds
*Assistant Examiner*—Tu Hoang
*Attorney, Agent, or Firm*—Koda and Androlia

[57] ABSTRACT

Super high polymeric polyethylene glycol whose molecular weight is 100,000 to 1,000,000 or a mixture of the same and polyethylene glycol whose molecular weight is 600 to 10,000 is dissolvedly mixed with carbon powder or mixed with it in the presence of a solvent so that the carbon powder is uniformly dispersed therein, and thus, a plane heater compound which is flexible at the normal temperature can be obtained. This compound is formed into a self-temperature control heater which can have a required switching temperature within a range of 5° to 60° C. mainly by varying a mixing ratio of polyethylene glycol having a molecular weight of 600 to 10,000. Such a plane heater can be applied for various purposes requiring low-temperature heating, such as preventing freezing or melting snow, and also high-temperature heating, such as heating/air conditioning.

2 Claims, 4 Drawing Sheets

SELF-TEMPERATURE CONTROL FLEXIBLE PLANE HEATER

BACKGROUND OF THE INVENTION

1. Industrial Field of the Invention

The present invention relates to a flexible plane heater and, more particularly, to a self-temperature control flexible plane heater.

2. Description of the Prior Art

A compound in a system of conductive particles and polyethylene glycol exhibits a certain switching characteristic in a relation between temperature and electric resistance (i.e., when the temperature increases, a value of the resistance abruptly increases at a threshold temperature). A self-temperature control heater making use of this characteristic has been suggested by the inventors of the present application, and already known, such as disclosed in EP-A1-0219678, U.S. Pat. No. 4,629,584, and U.S. Pat. No. 4,780,247. In addition, it has been reported from a study that this performance of self-temperature control is attributed not to thermal expansion of volume of the compound in such a system but to electron displacement through layers of polyethylene glycol which are interposed between the conductive particles ("Polymer", vol. 29; p. 526, 1988). According to this report, the formation of crystalline phase in polyethylene glycol is requisite in order to enable the performance of self-temperature control. In effect, it has been also concluded from the investigation up to the present by the inventors of the present application that crystalline phase of the compound is essential for performing the self-temperature control.

U.S. Pat. No. 4,780,247 mentioned above has also suggested that, when an amount of polyethylene glycol whose molecular weight is about 100 to 50,000 is controlled for mixing, switching temperature can be desirably varied and set within a range of about 5° to 70° C. In this manner, it has been progressively proved that the compound includes an excellent characteristic to serve as a heater, e.g., a heater panel for heating at 50° C. or more and is of great value in practical use.

However, high polymers which contain a large number of crystalline phases (whose degree of crystallinity is high) ordinarily exhibit high brittleness and lack flexibility. For the reason, the conventional self-temperature control heater of the compound in the conductive-particles/polyethylene-glycol system has usually included polyethylene glycol whose molecular weight is about 600 to 6,000, and consequently, not only shape recoverability but also flexibility has been still unfavorable.

Polyethylene glycol is in a liquid state at the normal temperature when the molecular weight is small ($M<600$), and as the molecular weight increases, polyethylene glycol is changed into a wax state and further proceeds into a solid state. When polyethylene glycol in the solid state is shaped into a film, the film is relatively brittle in case of the low molecular weight. But if the molecular weight is over 100,000, such a film becomes flexible. Polyethylene glycol having a molecular weight of 600 to 6,000 which has been used for melting snow or heating takes the most remarkable switching effect, but on the other hand, there has been a problem that this kind of polyethylene glycol has high crystallinity, resulting in that only brittle films will be produced.

In the present invention, the inventors have succeeded in developing a plane heater whose flexibility is realized by using super high polymeric polyethylene glycol so as to change crystalline phase of polyethylene glycol, and which plane heater also performs desirable self-temperature control In this specification, any chemical substance containing a chain of $-(CH_2-CH_2-O)_n-$ as a unit structure is referred to as polyethylene glycol.

SUMMARY OF THE INVENTION

Taking into consideration the switching characteristic and the material property change of polyethylene glycol described above, a flexible self-temperature control plane heater has been accomplished by using polyethylene glycol having a high molecular weight. Further, a sheet of this self-temperature control plane heater having electrodes provided therein is enveloped with softened insulator means, and thus, a flexible plane heater has been developed.

Accordingly, one object of the present invention is to provide a self-temperature control flexible plane heater wherein super high polymeric polyethylene glycol whose molecular weight is 100,000 to 1,000,000 is dissolvedly mixed with carbon powder or mixed with it in the presence of a solvent, to form a heat-sensitive electrically resistant compound which contains electrodes therein, and such a heat-sensitive electrically resistant compound is enveloped with softened insulator means.

Further object of the present invention is to provide a self-temperature control flexible plane heater wherein a mixture of super high polymeric polyethylene glycol whose molecular weight is 100,000 to 1,000,000 and Polyethylene glycol whose molecular weight is 600 to 10,000 in case of melting snow or 2,000 to 10,000 in case of heating is dissolvedly mixed with carbon powder (CG) or mixed with it in the presence of a solvent, to form a heat-sensitive electrically resistant compound which contains electrodes therein, and such a heat-sensitive electrically resistant compound is enveloped with softened insulator means.

A mixing ratio of carbon powder to polyethylene glycol is normally 5 to 45 weight %. For softened insulator means, rubber and softened plastics or these materials reinforced by fabric and nonwoven fabric are used. As a solvent, an aromatic solvent such as benzene, toluene or xylene is used.

Concerning the reason why polyethylene glycol becomes flexible in a solid state as the molecular weight increases, no one has ever come to a definite conclusion, but the following two reasons can be assumed. (I) As the molecular weight increases, an amorphous region of polyethylene glycol is enlarged. (II) As crystals of the extended molecular chain are converted into crystals of the lamella structure, flexibility of polyethylene glycol in a solid state is improved. Although the first reason is qualitatively feasible, it has a problem in the quantitative explanation, and accordingly, the second reason should be taken into account under the present situation. However, because polyethylene glycol whose molecular weight exceeds 1,000,000 performs inferior self-temperature control, the first reason is more suitable. As a result of this function, a highly flexible plane heater element can be obtained from the above-stated arrangement, and when the element is protected with insulator coatings of soft rubber-type materials, an excellent flexible heater can be obtained.

These and other objects and advantages of the invention will become clear from the following description of the preferred embodiments.

DETAILED DESCRIPTION OF THE EMBODIMENTS

The structure and effects of the present invention will be hereinafter described in detail according to the embodiments.

EXAMPLE 1

Figure 1:
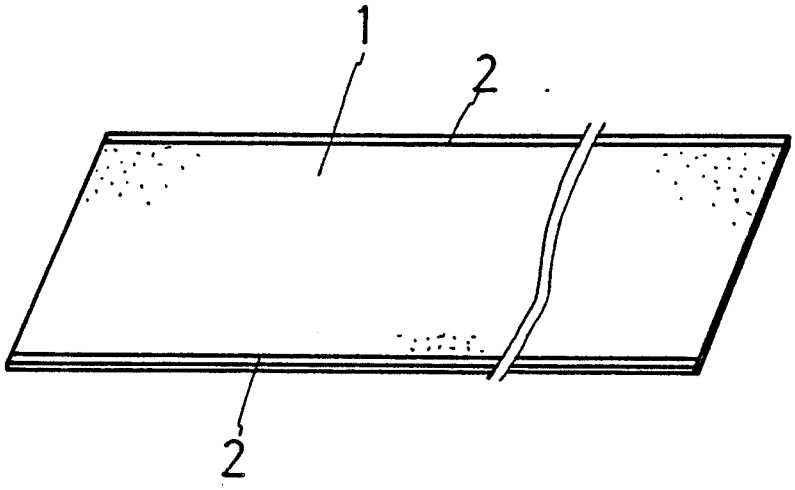
FIG. 1 is a perspective view showing a flexible plane heater according to one embodiment of the present invention.
Figure 2:
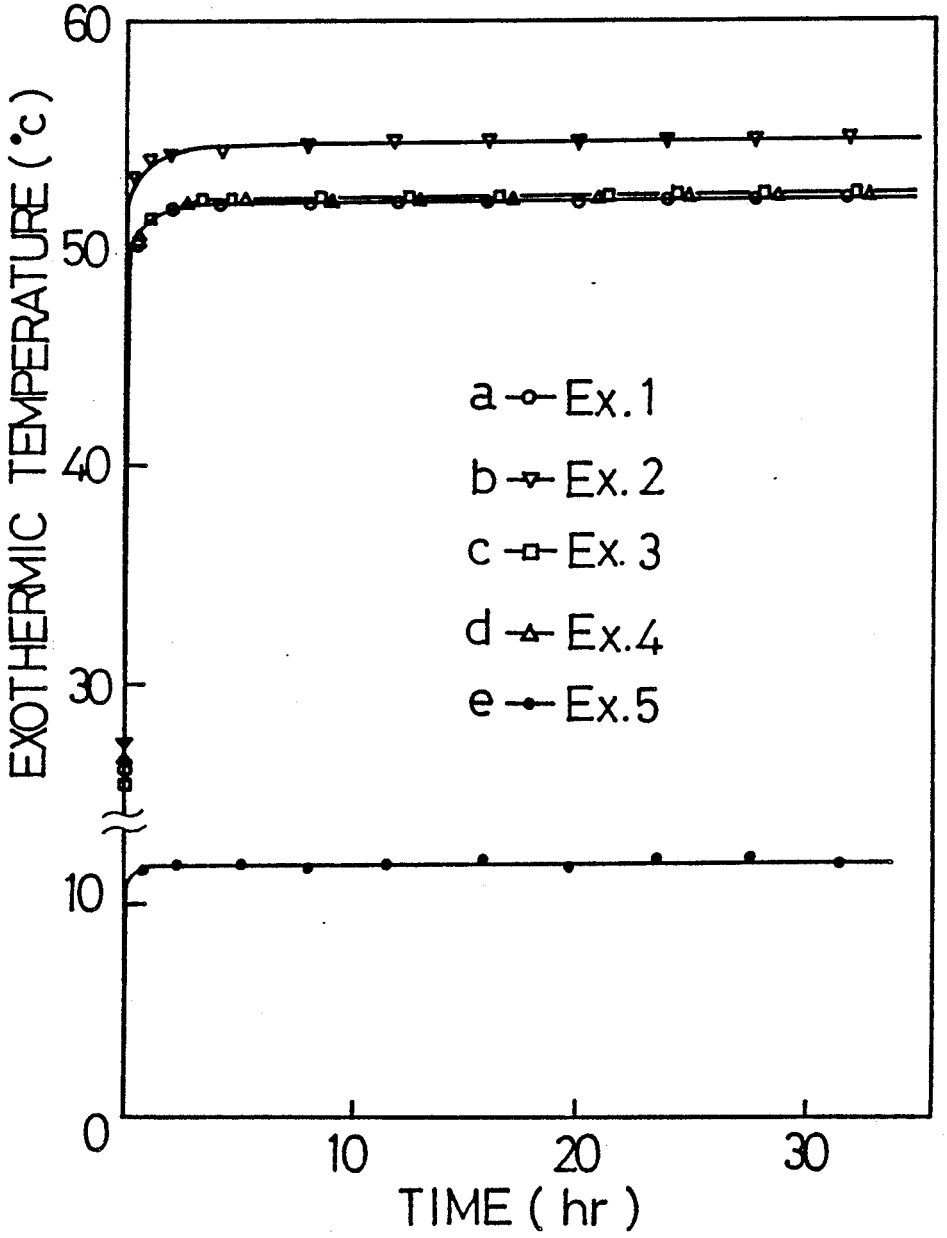
FIG. 2 is a graph showing exothermic temperatures of plane heaters in relation to time.
Figure 3:
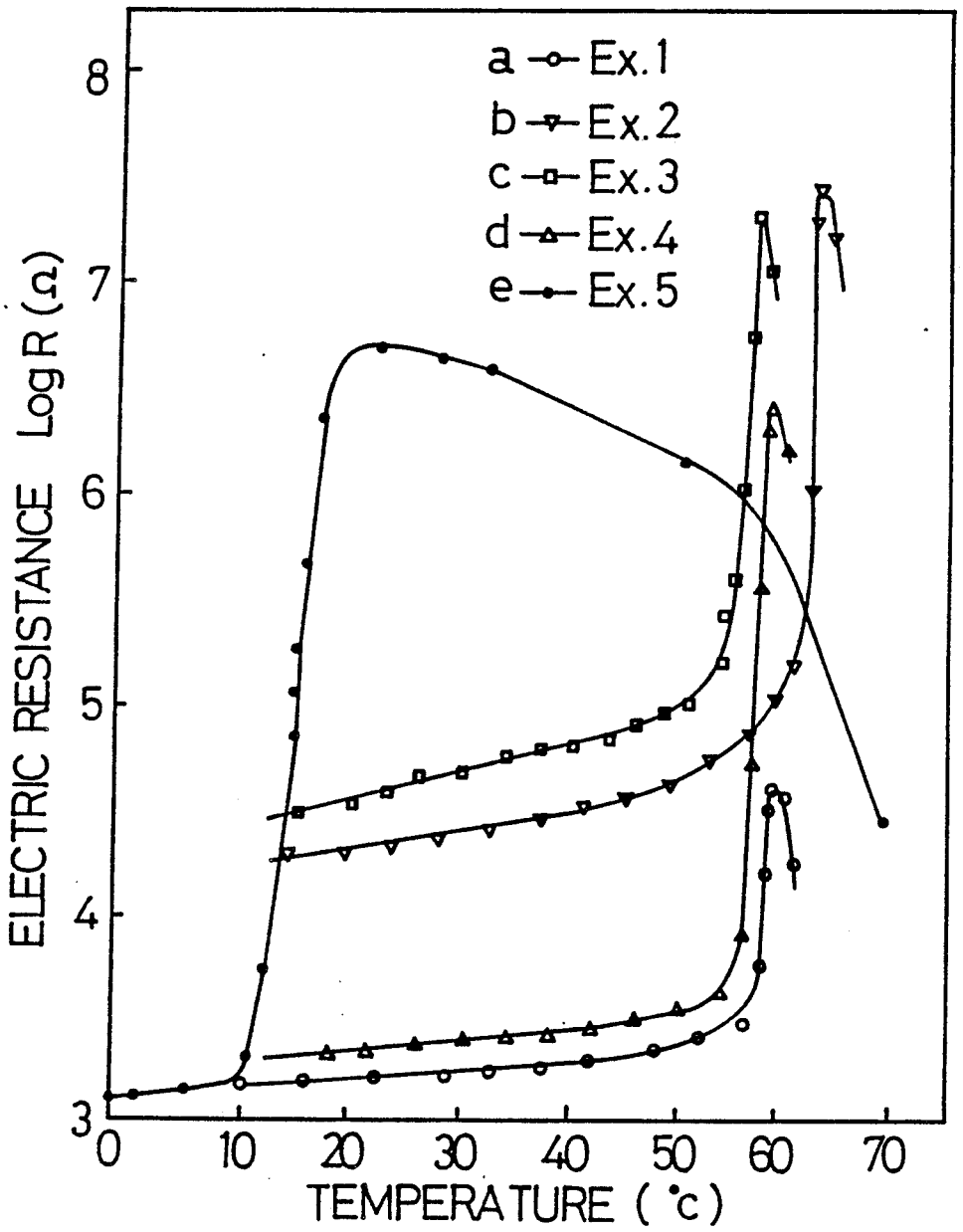
FIG. 3 is a graph showing characteristics in temperature/resistance relations of plane heaters according to the present invention.

95 weight parts of toluene (parts below will all indicate weight parts, unless specified otherwise) was mixed with 5 parts of polyethylene glycol whose average molecular weight was approximately 1,000,000 (Polyox <WSR N-12K>available from Union Carbide Corporation, U.S.), and after the polymer was adequately dissolved, 1.58 parts of scale-like graphite (90–300M from Nishimura Kokuen Co., Japan) was dispersed in the solution. This solution was supplied between electrodes of netlike shielding wire which had been previously provided on a glass plate, and the supplied solution was dried to form a plane heater 1 whose length was 30 cm, the distance between the electrodes 2 being 76 mm, as shown in FIG. 1, and the plane heater was dried in a vacuum environment to remove the solvent therefrom. The plane heater 1 thus obtained was superior to the conventional one in flexibility. With the top and bottom surfaces of this plane heater being further covered with urethane foam sheets each having a thickness of 5 mm, AC100V was applied to the plane heater. Exothermic temperature of the plane heater was determined at intervals of a predetermined period of time, the result being illustrated with a curve a of FIG. 2. From this graph, it can be clearly understood that the plane heater of the above-described composition performs the self-temperature control. Referring to FIG. 3, however, in a graph plotting the relation between the temperature and the electric resistance of the plane heater, a characteristic curve a extends low-level to some extent relative to the conventional plane heater including polyethylene glycol whose molecular weight is about 2,000. To sum up, the flexibility is extremely high, but the switching characteristic is substantially inferior. This can be such explained that, as the molecular weight becomes larger, the amorphous portion is increased, thereby resulting in the high flexibility, whereas decrease of the crystalline portion induces the inferior switching characteristic. It may be also explained by difference between crystals of the extended molecular chain and crystals of the lamella structure.

EXAMPLE 2

5 parts of polyethylene glycol whose molecular weight was 400,000 (Polyox <WSR N-3000> available from Union Carbide Corporation, U.S.) was dissolved in 95 parts of toluene, and after dissolution was completed, 1.58 parts of scale-like graphite (90–300M from Nishimura Kokuen Co., Japan) was dispersed in the solution. This solution was poured over a glass plate provided with the same electrodes 2 as used in the example 1, and after the solvent was evaporated, the solution was dried in a vacuum environment so as to form a plane heater 1. With this plane heater being further covered with styrene foam sheets each having a thickness of 5 mm, AC100V was applied to the plane heater. Exothermic temperature of the plane heater was determined at intervals of a predetermined period of time, the result being illustrated with a curve b of FIG. 2. A characteristic curve plotting the temperature/resistance relation of the plane heater is illustrated as b in FIG. 3. In this case, the switching characteristic is a little inferior to that of the conventional less flexible plane heater including Polyethylene glycol (#6000), but is far superior to that of the example 1 including polyethylene glycol whose molecular weight is 1,000,000, and there is no problem for practical use. Further, enough flexibility can be given to the plane heater.

EXAMPLE 3

Figure 4:
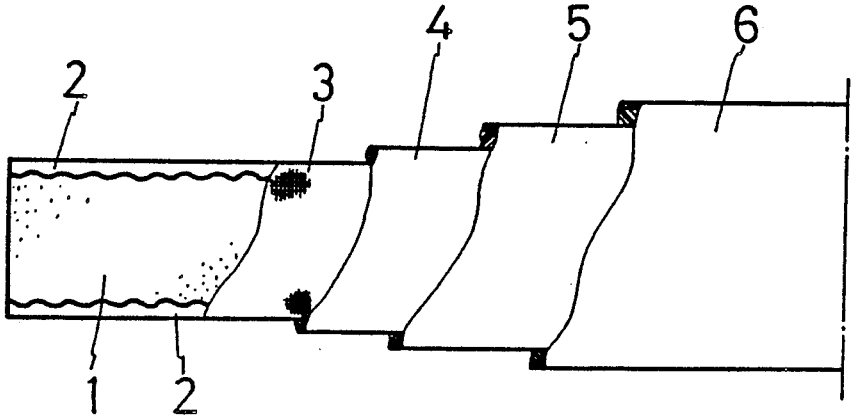
FIG. 4 is a sectional view partially broken away showing a flexible plane heater according to one embodiment of the present invention.

Examples of a flexible tape-like heater will now be explained. At a temperature of 100° C., 30 parts of polyethylene glycol whose molecular weight was 400,000 (Polyox <WSR N-3000> available from Union Carbide Corporation, U.S.) was mixed with 47 parts of polyethylene glycol whose molecular weight was 3050 (#4000 from Daiichi Kogyo Seiyaku Co., Japan), and after such mixing, 23 parts of graphite (J-SP from Nippon Kokuen Co., Japan) was added to the mixture for further mixing at the same temperature so as to form a tape-like plane heater 1 with the distance between the electrodes being 10 mm, as shown in FIG. 4. Polyester fabric 3 and a polyester film (25 $\mu$) 4 were wrapped around this plane heater, and a coating layer of sol-state dry-type vinyl chloride 5 and a coating layer of sol-state dry-type silicone rubber 6 were further enveloped around them. Exothermic temperature of this plane heater after AC100V was applied to it was determined at intervals of a predetermined period of time, the result being illustrated with a curve c of FIG. 2. Referring to FIG. 3, a characteristic curve plotting the temperature/resistance relation of the plane heater is illustrated as c in the graph. BY the plane heater in this case, it was intended to utilize a kind of polyethylene glycol exhibiting the desirable switching characteristic, and also to provide flexibility. It is clearly taught by the curve c of FIG. 3 that the resistance is increased into a value of four more digits to ensure the superior switching characteristic. Besides, it was observed that this plane heater had suitable flexibility.

EXAMPLE 4

At a temperature of 100° C., 30 parts of polyethylene glycol whose molecular weight was 400,000 (Polyox <WSR N-3000> available from Union Carbide Corporation, U.S.) was mixed with 47 parts of polyethylene glycol whose molecular weight was 8200 (#6000 from Daiichi Kogyo Seiyaku Co., Japan), and after such mixing, 23 parts of graphite (J-SP from Nippon Kokuen Co., Japan) was added to the mixture for further mixing at the same temperature so as to form a plane heater similar to that of the example 3, as shown in FIG. 4. With the top and bottom surfaces of this plane heater being further covered with styrene foam sheets each having a thickness of 100 mm, AC100V was applied to the plane heater. Exothermic temperature of the plane heater was determined at intervals of a predetermined period of time, the result being illustrated with a curve d of FIG. 2. Referring to FIG. 3, a characteristic curve plotting the temperature/resistance relation of the plane heater is illustrated as d of the graph. In this case, the plane heater thus obtained can also effect the suitable switching characteristic and the desirable flexibility to the same extent as the example 3. Needless to say, polyethylene glycol having a low molecular weight causes slightly different exothermic temperatures between the examples 3 and 4.

EXAMPLE 5

A flexible plane heater arranged for low temperature, which is useful for melting snow when mounted on the surface of a roof or the like, will now be described.

After mixing 25 wt % graphite (90–100M, average 300 mesh, 13 μ, available from Nishimura Kokuen Co., Japan), 60 wt % polyethylene glycol #600 (average MW 600, from Daiichi Kogyo Seiyaku Co., Japan), and 15 wt % Polyox (N-12K)(average MW 1,000,000, from Union Carbide Corporation, U.S.), the mixture was heated and dissolved to form a heat-sensitive electrically resistant compound, which was shaped into a disk having 20 mmΦ and a thickness of 2 mm.

Both the top and bottom surfaces of this disk were coated with Ag-Paint so that each coating served as an electrode.

The disk piece thus obtained was set in a thermostat maintaining 0° C., and the temperature was changed to determine a value of resistance between both electrodes. The result is shown in the left side of FIG. 3.

As clearly understood from a curve in this graph, the value of resistance abruptly begins to increase at about 10° C., continues increasing until about 18° C., and stops increasing at about 18° C. to be stabilized as a substantial peak. The value continues to be in this condition until about 50° C. If the temperature is then made lower, the value of resistance becomes small again at 10° C. or below, and the disk piece recovers the former state as a good conductor.

It is obvious from the above result that, according to this example, a self-temperature control low-temperature heater which exhibits the desirable switching characteristic (i.e., the heat-sensitive electrically resistant characteristic) at about 10° C. can be obtained. In addition, the disk shape can be maintained in a steady state at the normal temperature.

A comparative result of a heater containing polyethylene glycol #600 and polyethylene #6000 (7:3) is illustrated in Table 1. Although the stabilized exothermic temperature is about 13.5° C., the value of resistance maintains a peak over a limited range of the temperature, and this heater effects neither flexibility nor shape recoverability.

TABLE 1

| | | EXAMPLE | | | | | COMPARATIVE EXAMPLE | | |
|---|---|---|---|---|---|---|---|---|---|
| | | 1 | 2 | 3 | 4 | 5 | 1 | 2 | 3 |
| PEG MW | 1,000,000 | 100 | | | | 15 | | | |
| | 400,000 | | 100 | 30 | 30 | | | | |
| | 100,000 | | | | | | 100 | | |
| #6000 (MW 8200) | | | | 47 | 47 | | | 100 | 15 |
| #4000 (MW 3050) | | | 47 | | | | | | |
| #600 (MW 600) | | | | | | 60 | | | 60 |
| CG | | 32 | 32 | 23 | 27 | 25 | 27 | 27 | 25 |
| STABILIZED TEMPERATURE | | 51.8 | 52 | 52.2 | 54.1 | 10.3 | 55.5 | 56.5 | 13.5 |
| SWITCHING CHARACTERISTIC | | Δ | ◎ | ◎ | ◎ | ◎ | ◎ | ◎ | ◎ |
| FLEXIBILITY | | ◎ | ◎ | ◎ | ◎ | ◎ | ○ | Δ | Δ |

◎ EXCELLENT
○ GOOD
Δ RELATIVELY INFERIOR

Next, the heat-sensitive electrically resistant composite 1 according to this example was shaped to have a width of 80 mm, a length of 300 mm, and a thickness of 0.36 mm, and enveloped as shown in FIG. 4 to form a flexible plane heater.

With the top and bottom surfaces of this plane heater were covered with urethane foam insulators each having a thickness of 10 mm, the plane heater was set in a thermostat maintaining 0° C., and AC200V was applied between the electrodes 2. Then, exothermic temperature of the plane heater was determined at intervals of a predetermined period of time. The temperature change is shown with a curve in the lower side of FIG. 2.

As illustrated with this curve, the exothermic temperature reaches 10.3° C. after 30 minutes, and from this moment, the plane heater continues to have this temperature, thereby proving that the plane heater of this example includes the desirable switching characteristic.

It is clearly seen from the matters described in conjunction with the above embodiments that a flexible plane heater can be obtained by using polyethylene glycol of a high molecular weight which exhibits flexibility. All properties of the plane heater samples which were ascertained by the results of experiments are shown in Table 1. However, it is also understood from the embodiments that, if the molecular weight is in an order of 1,000,000 or more, the switching characteristic of the compound in the graphite-polyethylene-glycol system is relatively inferior. Further, if a plane heater contains polyethylene glycol having a molecular weight of not more than 600, the switching temperature is too low, and such a plane heater is inadequate for practical use, as clearly seen from the above embodiments and comparative examples of Table 1.

In the examples 3 and 4, the switching characteristic is prevented from becoming unfavorable, and also, the flexibility is increased. As a matter of course, a plane heater including one kind of polyethylene glycol having a high molecular weight is more flexible than a plane heater including a mixture of the same and polyethylene glycol #4000 or #6000. However, a plane heater including two kinds of polyethylene glycol such as the examples 3 and 4 can provide sufficient flexibility for practical use. According to this method, the plane heater can have not only a desired exothermic temperature but also favorable flexibility.

Figure 5:
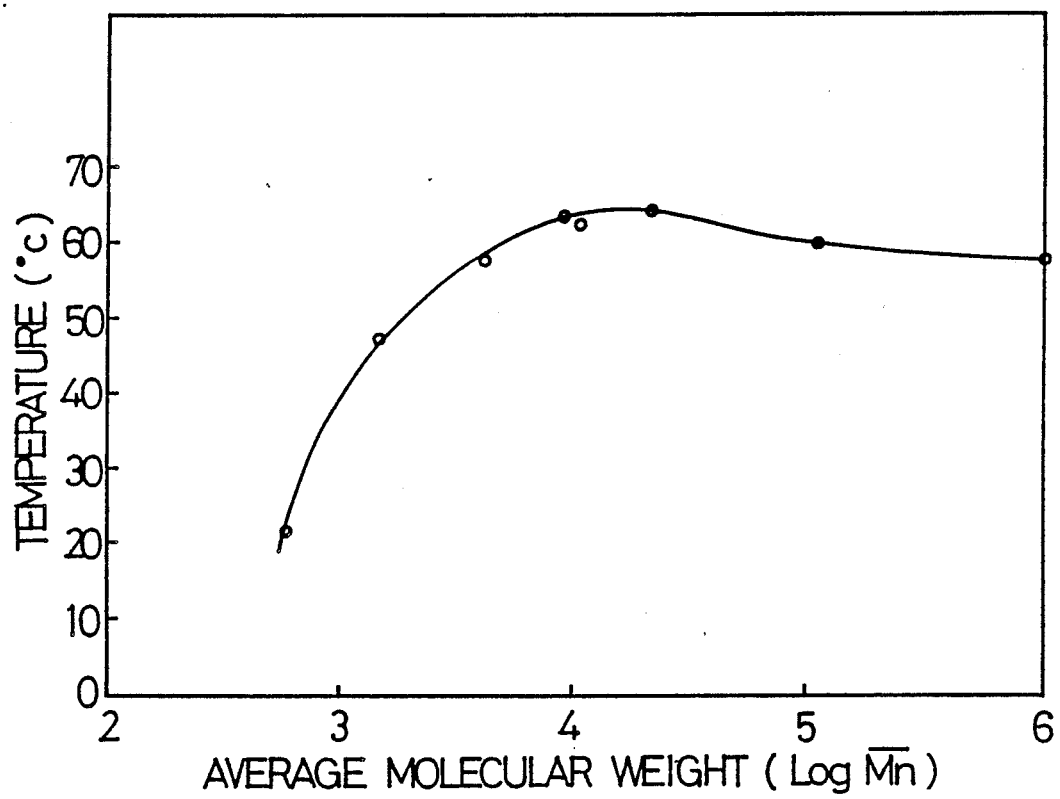
FIG. 5 is a graph showing a relation between an endothermic temperature and a molecular weight according to a measuring method of DSC (differential scanning calorimetry).

As described previously, high flexibility, which is caused by increase of the molecular weight, and inferior switching characteristic probably originate from (I) increase of the amorphous region or (II) change of the crystal condition, so that these factors should be taken into consideration. Referring to FIG. 5, as for an endothermic temperature peak owing to melting according to a measuring method of DSC (differential scanning calorimetry), when the molecular weight is relatively small, the endothermic temperature becomes higher, as the molecular weight increases, but from a certain value of the molecular weight, the peak stops increasing and becomes lower, as the molecular weight increases. Judging this phenomenon shown by a graph of FIG. 5, the present invention provides the composition, i.e., the mixture of polyethylene glycol having a molecular weight of 100,000 to 1,000,000 and polyethylene glycol having a molecular weight of 600 to 10,000. When this mixture is used, a plane heater exhibiting the practically suitable switching characteristic and the flexibility desirable for actual use can be obtained.

What is claimed is:

1. A self-temperature control flexible plane heater wherein a mixture of super high polymeric polyethylene glycol whose molecular weight is about 100,000 to 1,000,000 and polyethylene glycol whose molecular weight is about 600–10,000 is dissolvedly mixed with carbon powder, to form a heat-sensitive electrically resistant compound which contains electrodes therein, and such a heat-sensitive electrically resistant compound is enveloped with softened insulator means.

2. A self-temperature control flexible plane heater wherein a mixture of super high polymeric polyethylene glycol whose molecular weight is about 100,000 to 1,000,000 and polyethylene glycol whose molecular weight is about 600 to 10,000 is mixed with carbon powder in the presence of a solvent, and evaporating the solvent after mixing to form a heat-sensitive electrically resistant compound which contains electrodes therein, and such a heat-sensitive electrically resistant compound is enveloped with softened insulator means.

* * * * *